US005806765A

United States Patent [19]

Weinstein

[11] Patent Number: 5,806,765

[45] Date of Patent: Sep. 15, 1998

[54] LIQUID DRINKING ASSEMBLAGE AND SYSTEM

[76] Inventor: Robert E. Weinstein, 177 Commonwealth Ave., Boston, Mass. 02116

[21] Appl. No.: 712,460

[22] Filed: Sep. 11, 1996

[51] Int. Cl.[6] ..... A47G 21/18

[52] U.S. Cl. ..... 239/33; D7/300.2; 215/388; 220/705

[58] Field of Search ..... 239/33; 220/705, 220/709; 215/229, 388, 389; D7/300.2

[56] References Cited

U.S. PATENT DOCUMENTS

| | | | |
|---|---|---|---|
| D. 182,721 | 5/1958 | Howes | D7/300.2 |
| D. 336,043 | 6/1993 | Provencio | D7/300.2 X |
| 2,052,307 | 8/1936 | Kennedy | 229/103.1 |
| 2,531,855 | 11/1950 | Loptson | D7/300.2 X |
| 3,260,462 | 7/1966 | Smaczny | 239/33 |
| 3,349,987 | 10/1967 | Weitzer | 229/103.1 |
| 3,409,224 | 11/1968 | Harp et al. | 239/33 |
| 3,773,256 | 11/1973 | Wright | 239/1 |
| 4,699,318 | 10/1987 | Donatello et al. | 239/33 |

*Primary Examiner*—Lesley D. Morris
*Attorney, Agent, or Firm*—Morse & Altman

[57] ABSTRACT

An assemblage and system for drinking a plurality of potable and/or medicinal liquids simultaneously from discrete receptacles. The assemblage comprises a plurality of conduits joined together that convey isolated streams of the liquids from separate receptacles into the mouth. The cross-sectional area of the conduits regulate the amount of each liquid reaching the mouth and may be dynamically controlled. Preferably, the conduits are mechanically deformable along their axes of elongation. Preferably, the conduits are joined together near the end of the conduits that enter the mouth. The conduits are joined by a catch, by binding, or by molding the conduits as a single unit. The system includes the assemblage and a number of isolated receptacles.

15 Claims, 3 Drawing Sheets

LIQUID DRINKING ASSEMBLAGE AND SYSTEM

BACKGROUND OF THE INVENTION

1. Field of the Invention

The present invention relates to dispensers for potable liquids, more specifically, to apparatus for conveying more than one liquid into the mouth discretely and simultaneously.

2. The Prior Art

When eating solid foods, it is common to simultaneously place more than one food into the mouth, i.e. meat and potato on a fork. This practice allows the eater to combine foods to satisfy his or her personal tastes. By virtue of the integrity of solid food, it is also possible for the eater to place additional food in the mouth before swallowing. An example might be having meat in the mouth, then taking a bite of bread, chewing and swallowing both. This allows the eater to spontaneously combine foods in the mouth to suit his or her tastes.

In contrast to solid foods, it is difficult to take in a second beverage while one is already in the mouth. A person takes a drink by either lifting the drink container to the mouth or by using a straw to draw the beverage into the mouth. In the former case, it is extremely difficult to take a second drink before swallowing the first mouthful— when the mouth is opened to take the second drink, the beverage already in the mouth will spill out. And in the latter case, it is very awkward to try to put the straw back into the mouth before swallowing the first mouthful. Either the straw must be pushed between clenched lips or the head must be tilted backwards to keep the beverage from spilling out.

One solution is to use two straws. There are several disadvantages to this. First, one must find two straws that are appropriate relative to each other. They may not have the necessary diameters or lengths. In addition, because the straws are not joined together, it is awkward to keep them fixed relative to each other, should it be desired.

Another solution is disclosed in U.S. Pat. No. 3,260,462, issued to Smaczny. Smaczny discloses a forked drinking straw, where there are two legs and a central tube. Each leg is inserted into a different container and the liquids are mixed either in the central tube or in a mixing chamber located at the junction of the legs and central tube prior to reaching the mouth. There are situations where mixing the liquids before reaching the mouth is not desirable. An example of such a case is when the combination creates an effervescent beverage, where, because of gas pressures, it would be dangerous to create the beverage in the confined space of a straw. Another example is when it is desired to taste the flavor of the different liquids separately and then combined.

Taste buds of a single type are grouped together and located in particular areas of the mouth. It is occasionally desirable to direct different components of a beverage to different locations in the mouth to take advantage of the location of particular types of taste buds. The Smaczny device will not work for this purpose because the beverage components are mixed prior to reaching the mouth. It is possible to use two separate straws for this purpose, but it is very awkward to hold the straws in fixed position relative to each other and relative to locations in the mouth and containers.

Thus, there is a continuing need for a device that can be used by a person to drink more than one liquid simultaneously such that the liquids are combined in the mouth and that can direct different liquids to different locations in the mouth simultaneously.

SUMMARY OF THE INVENTION

An object of the present invention is to provide an assemblage that facilitates the desire of a person to ingest potable and/or medicinal liquids from several containers simultaneously.

Another object is to provide an assemblage that allows a person to experience individual liquids separately and then combined.

A further object is to provide an assemblage that allows a person to combine several liquids in the mouth in a desired ratio.

A further object is to provide an assemblage that allows a person to simultaneously direct several liquids to different locations in the mouth.

Another object is to provide a system for containing and dispensing a plurality of potable and/or medicinal liquids whereby the liquids can be ingested simultaneously.

Another object is to provide a system for containing and dispensing a plurality of potable and/or medicinal liquids whereby a person can experience individual liquids separately and then combined.

Another object is to provide a system for containing and dispensing a plurality of potable and/or medicinal liquids whereby the liquids can be combined in a desired ratio.

A further object of the present invention is to provide a system for containing and dispensing a plurality of potable and/or medicinal liquids whereby the liquids can be simultaneously directed to different locations in the mouth.

To meet these objectives, the present invention has two basic embodiments: a drinking assemblage for drinking a plurality of potable and/or medicinal liquid simultaneously from isolated receptacles and a system that combines the drinking assemblage with a container of liquid receptacles.

The drinking assemblage consists of a plurality of conduits joined so as to direct isolated streams of the liquids from receptacles into the mouth. Each conduit is composed of a semi-flexible material, rigid enough so that the conduit will not bend over from the force of gravity when standing on end. A plastic will provide the assemblage with a long useful life and a coated paper will provide the assemblage with a low manufacturing cost.

Typically, the conduits will have the same length. The length may be shortened in order to customize the assemblage for a particular use.

The cross-sectional shape may be formed into any desired shape, but is typically round. The cross-sectional area of the conduits are typically the same, but can be formed to regulate the amount of each liquid reaching the mouth at the same time or to accommodate liquids of differing densities. In addition, the cross-sectional area can be controlled dynamically by pinching the conduit walls. In this way, the proportion of liquids reaching the mouth can be changed dynamically to accommodate the tastes of the drinker.

The conduit may be longitudinally rigid or mechanically deformable by applying force. In the rigid embodiment, the conduit will maintain its longitudinal shape under a moderate amount of stress. In one deformable embodiment, the conduit does not maintain the deformed shape after the force is removed. In another deformable embodiment, the deformed shape is maintained. One way to maintain the deformed shape is to provide the conduit with a bellows, a device well known in the art.

The conduits are joined together while maintaining the isolation of the liquids prior to reaching the mouth. Preferably, the area of the outer surfaces where the conduits are joined together, the contact area, should be large enough so that the conduits remain joined together under a modest amount of stress. The contact area location can be anywhere along the length of the conduits, but is preferably near the end of the conduits that enter the mouth. The conduits are joined by either binding already existing conduits together or by forming the conduits as a single unit.

The drinking system of the second embodiment consists of a drinking assemblage and a container of discrete receptacles. The assemblage is substantially the same as the drinking assemblage described above. It may be either separate and packaged with the container or it may be positioned permanently in the receptacles.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
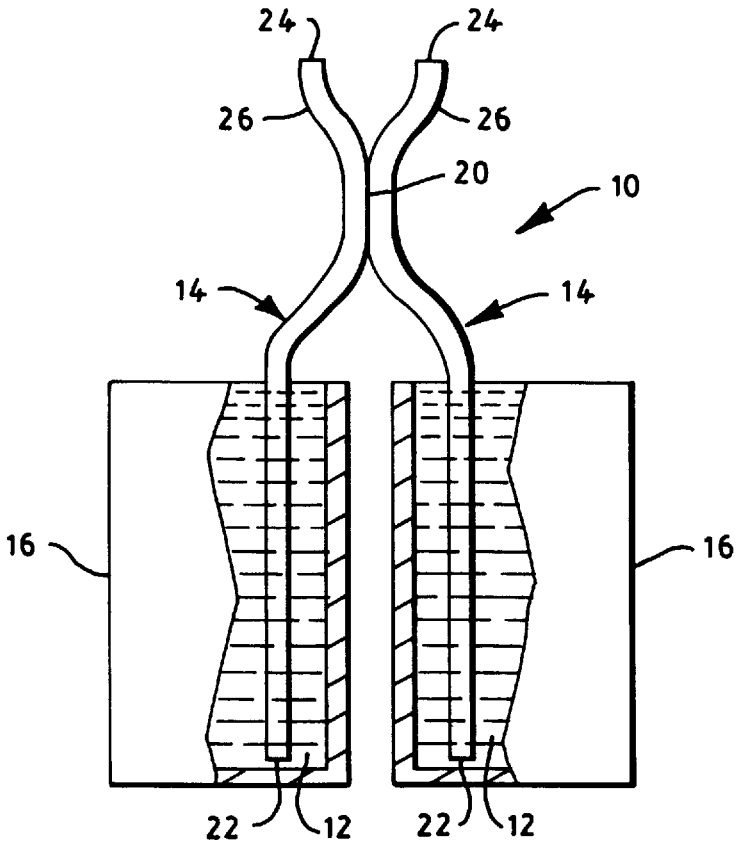
FIG. 1 is a perspective view of the first embodiment of the present invention.

The present invention has two basic embodiments. The first is an assemblage for drinking a plurality potable and/or medicinal liquid simultaneously from isolated receptacles. The second embodiment is a system that combines the drinking assemblage with a container of liquid receptacles.

Drinking Assemblage of FIGS. 1–6

The drinking assemblage 10 consists of a plurality of conduits 14 joined together. The conduits 14 conduct isolated streams of the liquids 12 from a plurality of receptacles 16 into the mouth, where the liquids 12 combine in the desired manner.

The receptacle configuration and the intended use of the assemblage determines the various parameters of the assemblage 10, including the material of which it is composed, the number of conduits 14, the length of the conduits 14, and the radial cross-sectional shape and area of the conduits 14.

The conduit 14 is preferably composed of a material that is somewhat flexible. The use to which the assemblage 10 will be put determines the material from which the conduit 14 it is made. A semi-rigid plastic, such as polyethylene or polypropylene, will provide the assemblage 10 with a long useful life and the ability to withstand the high temperatures needed to cleanse and disinfect the assemblage 10 for future use.

A coated paper will provide the assemblage 10 with a short life, typically for one use only, but is less expensive to manufacture than a plastic assemblage. The coating prohibits the liquid from soaking into the paper and is preferably a wax or plastic.

Typically, the conduits 14 will have the same length, the length being defined as the linear distance between the ingress 22 and egress 24 of the conduit 14. If the receptacles 16 have different depths, the conduit lengths may be different. In addition, any of the conduits 14 may be shortened in order to customize the assemblage 10 for a particular use.

The preferred cross-sectional shape of each conduit 14 is round. However, any shape may be used, such as semicircular, square or octagonal and different conduits 14 of the same assemblage 10 may have different shapes. The selection of the appropriate cross-sectional shape for a given application depends upon a number criteria, including the use being made of the assemblage 10, the number of conduits 14 attached together to form the assemblage 10, how the conduits 14 are joined together, and the market at which the assemblage 10 is targeted.

Different conduits 14 of the same assemblage 10 may have different cross-sectional areas, which can be used to regulate the relative amounts of the liquids 12 reaching the mouth at the same time. The cross-sectional area determines the flow of liquid 12 through the conduit 14 for a given amount of force. A smaller cross-section will provide less liquid 12 than a larger cross-section with the same amount of force.

Another factor in determining the cross-sectional area of each conduit 14 is the density of the liquids 12 with which the assemblage 10 will be used. For example, a conduit 14 for use with water does not have to be as large as a conduit 14 used for a syrup in order to convey the same amount of each, because a syrup is thicker than water.

The cross-sectional area can be controlled by squeezing and releasing the walls 26 of the conduit 14. In one embodiment, the cross-section will substantially maintain its shape after the squeezing pressure is released. In another embodiment, the cross-section of a plastic conduit 14 will return substantially to its original shape when released. This later ability allows the drinker to dynamically regulate the flow of liquid 12 in the conduit 14 by squeezing and releasing the conduit wall 26 with the fingers. In this way, different amounts of the liquids 12 can be mixed, dynamically changing the flavor of the liquid combination to suit the drinker.

Figure 2:
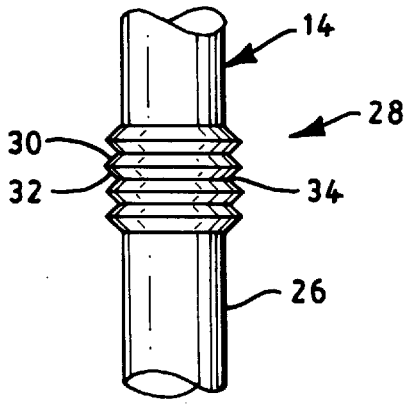
FIG. 2 is a side view of a conduit with a bellows in an extended state.
Figure 3:
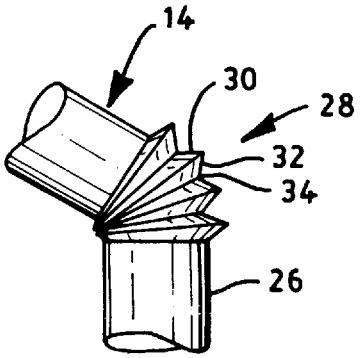
FIG. 3 is a side view of a conduit with a bellows in a partially contracted state.

The conduit 14 is mechanically deformable by applying force so that the linear shape can be adjusted for a particular use. In one embodiment, the conduit 14 does not maintain the deformed shape after the force is removed. In another embodiment, the deformed shape is maintained. One way in which the shape is maintained after the force is removed is to provide the conduit with at least one bellows 28. The bellows 28, shown in FIGS. 2 and 3, is formed by an accordion of the conduit wall 26. A bellows wall 30 has two normal states relative to an adjacent wall 32: separated from the adjacent wall 32 after the ends of the conduit 14 are pulled apart, as in FIG. 2, and substantially parallel to the adjacent wall 32 after the ends of the conduit 14 are pushed together, as in FIG. 3. Opposed locations along the circumference of the walls 30, 32 may be in the same or different states. The junction 34 between the walls 30, 32 is designed such that the walls snap between the two states so the state is retained. The length of the bellows 28 and the number of walls 30, 32 that it includes depends upon the conduit material and the maximum deformation desired. Bellows of this type have been used for decades and are well known in the art.

The assemblage 10 is a combination of two or more conduits 14 that are joined together while maintaining the isolation of the streams of liquids 12. Preferably, the area of the outer surfaces 26 where the conduits 14 are joined together, the contact area 20, is a patch larger than a point. The contact area 20 should be large enough so that the conduits 14 remain joined together under a modest amount of stress. For example, both conduits 14 have a contact area 20 that is flat. In another example, one conduit 14 has a convex contact area 20 and the other has a concave contact area 20.

The conduits 14 may be joined together in any orientation. In the preferred orientation, the longitudinal axes of the conduits 14 are parallel at the contact area 20. At the other extreme, the axes at the contact area 20 are perpendicular.

The location of the contact area 20 is also determined by the intended use of the assemblage 10. If the liquids 12 are to be combined immediately upon entry into the mouth, the contact area 20 can be adjacent to the egresses 24. For other uses, the contact area 20 can be away from the egresses 24, as in FIG. 1.

Figure 4:
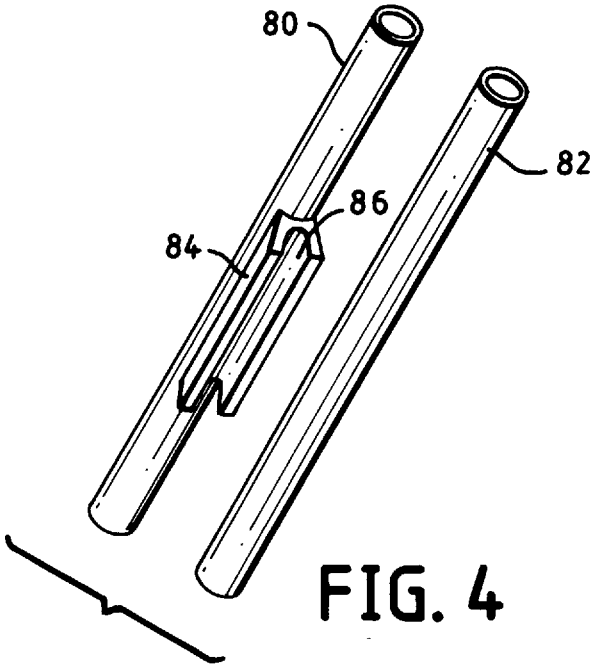
FIG. 4 is an isometric view of one embodiment of the joining of two conduits by interlocking.

The conduits 14 are joined in one of three preferred ways. The first is to join the conduits 14 together after being individually formed by interlocking catches on at least one of the conduits. For example, as shown in FIG. 4, one conduit 80 has a longitudinal protrusion 84 with a longitudinal cylindrical depression 86. The depression 86 is sized to snap around the circumference of another conduit 82 and to maintain a junction with the other conduit 82 under a modest amount of pressure. The conduits 80, 82 may be separated by pulling them apart to overcome the snap action of the depression 86.

Figure 5:
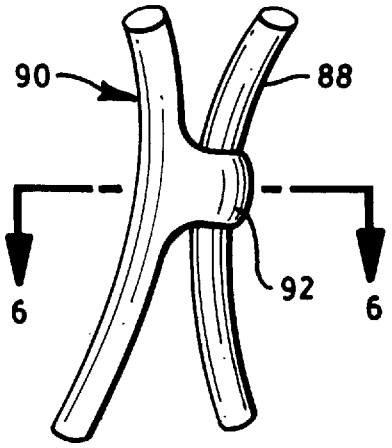
FIG. 5 is an isometric view of another embodiment of the joining of two conduits by interlocking.
Figure 6:
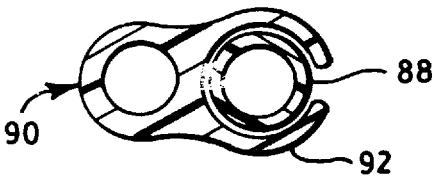
FIG. 6 is a cross-sectional view of the assemblage of FIG. 5 along the line 5—5.

Alternatively, as in FIGS. 5 and 6, one conduit 90 is molded around an already existing conduit 88. An already existing first conduit 88 is placed into the mold for forming a second conduit 90. The mold is shaped so that an element 92 of the second conduit 90 encompasses a portion of the first conduit 88. Whether or not the conduits 88, 90 can be separated after molding depends on how much of the circumference of the first conduit 88 is encompassed and on how flexible the second conduit material is.

The second method is to cement or weld the conduits 14 together after being individually formed. Cementing can be used with both plastic and coated paper conduits 14. If the conduits 14 are composed of plastic, they may be welded together such as by applying heat at the contact area 20 and "melting" the conduits 14 together. There are several advantages offered by joining the conduits 14 after they are formed. These include the ability to create small lots of specialized assemblages 10 and the ability to create shapes that cannot be created by molds.

The assemblage 10 can also be formed as a single unit, where the conduits 14 are already joined together. Depending upon where along the conduits 14 they are joined, this may be a more practical approach than forming the conduits 14 and joining them later. The conduits 14 are preferably formed in a mold. Different molds can be made to create assemblages 10 with a varying numbers of conduits 14 joined at different locations along their outside surfaces 26. In this way, special configurations of the conduits 14 can be made. Molding will work easily only with plastic conduits 10; it is not practical for use with coated paper.

Figure 7:
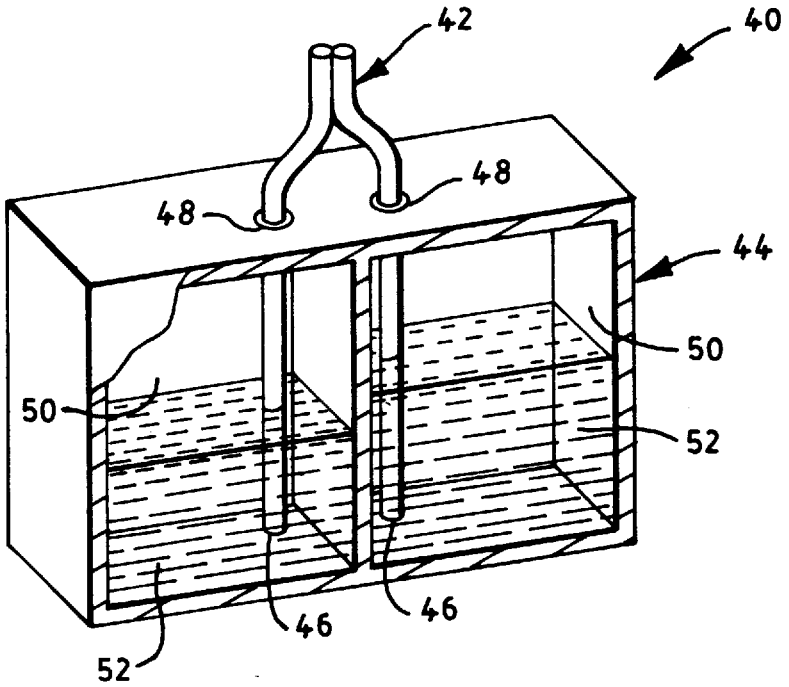
FIG. 7 is a cut-away perspective view of one configuration of the second embodiment of the present invention.
Figure 8:
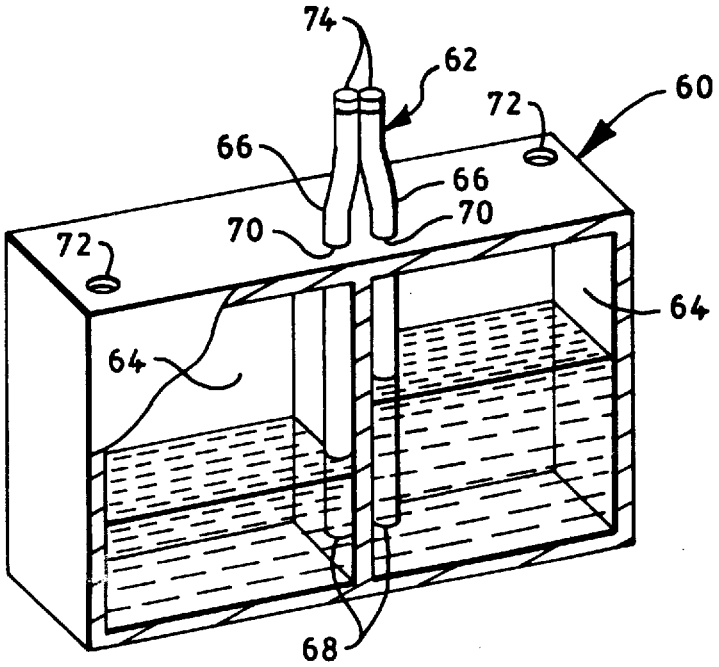
FIG. 8 is a cut-away perspective view of another configuration of the second embodiment.

The Drinking System of FIGS. 7 and 8

In another embodiment of the present invention, the drinking assemblage is one component of a drinking system, which includes the receptacles in which the liquids for drinking are stored. In this embodiment, all of the receptacles are discrete compartments within a single container.

The receptacles may be single-use or refillable. They may be prefilled by the supplier or filled by the drinker. Many different configurations of receptacles are possible and all are contemplated for use with the present invention.

There are two configurations of the system embodiment. In the first embodiment 40, shown in FIG. 7, the drinking assemblage 42 is separate but packaged with the container 44. The system 40 is designed so that the user inserts the conduit ingresses 46 through openings 48 in the receptacles 50 into the liquid 52 when ready to drink. Prior to inserting the ingresses 46, the openings 48 are covered to prevent spillage and/or contamination of the liquid 52. The covers are removed manually.

In the second configuration, an example of which is shown in FIG. 8, the system 60 is manufactured with the assemblage 62 positioned permanently in the receptacles 64. The conduits 66 are formed with the receptacles 64 such that the ingress 68 communicates with the liquid in the receptacle 64 and the conduit 66 exits the receptacle 64 through a water-tight aperture 70. Preferable, there is an opening 72 in the top wall of each receptacle 64 that allows air into the receptacle 64 during drinking in order to equalize pressure. Alternatively, the container is composed of materials that allow the receptacles to collapse as liquid is removed in order to equalize pressure. The conduit egresses 68 are capped to prevent spillage and/or contamination. The cap 74 is removable by the user prior to drinking. The pressure openings 72 are covered to prevent spillage and/or contamination and are opened by the user prior to drinking.

Thus it has been shown and described a drinking assemblage and system which satisfy the objects set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A drinking assemblage for enabling a person to ingest streams of potable or medicinal liquids simultaneously from a plurality of receptacles into a plurality of oral locations, said drinking assemblage comprising:

(a) a plurality of conduits, each having an ingress, an egress, and an axis of elongation;

(b) each of said conduits being joined to at least one other of said conduits at a junction that lies between said ingress and said egress, said junction being located such that said egress is free to be separated from all other of said egresses to direct said liquids to said plurality of oral locations;

(c) said ingresses being adapted for communication respectively with said liquids within said plurality of receptacles;

(d) said egresses being adapted for communication respectively with said plurality of oral locations; and (e) said liquids being isolated from each other when in said conduits.

2. The drinking assemblage of claim 1 wherein each of said conduits is capable of being mechanically deformed along said axis of elongation.

3. The drinking assemblage of claim 2 wherein each of said conduits is capable of retaining said mechanical deformation.

4. The drinking assemblage of claim 3 wherein said mechanical deformation is retained by at least on bellows.

5. The drinking assemblage of claim 1 wherein said axes of elongation are approximately parallel at said junction.

6. The drinking assemblage of claim 1 wherein said conduits are composed of coated paper.

7. The drinking assemblage of claim 1 wherein said conduits are composed of plastic.

8. A drinking system comprising:

(a) a plurality of receptacles for holding potable or medicinal liquid, each of said receptacles having an opening;

(b) a drinking assemblage including a plurality of conduits, the number of said conduits being equal to the number of said plurality of receptacles, each of said conduits having an ingress, an egress, and an axis of elongation;

(c) each of said conduits being joined to at least one other of said conduits at a junction that lies between said ingress and said egress, said junction being located such that said egress is free to be separated from all other of said egresses to direct said liquids to a plurality of oral locations;

(d) said ingresses being adapted for communication respectively with said liquids within said plurality of receptacles;

(e) said egresses being adapted for communication respectively with said plurality of oral locations; and (f) said liquids being isolated from each when in said receptacles and said conduits.

9. The drinking system of claim 8 wherein said receptacles are within a single container.

10. The drinking system of claim 9 wherein said conduits are composed of plastic.

11. The drinking system of claim 8 wherein each one of said conduits is integrated with one of said receptacles.

12. The drinking system of claim 8 wherein said conduits are insertable into and removable from said receptacles.

13. The drinking system of claim 8 wherein each of said conduits is capable of being mechanically deformed along said axis of elongation.

14. The drinking system of claim 13 wherein each of said conduits is capable of retaining said mechanical deformation.

15. The drinking system of claim 14 wherein said mechanical deformation is retained by at least one bellows.

* * * * *